United States Patent [19]

Foreman

[11] 4,013,172

[45] Mar. 22, 1977

[54] FILE CARD HOLDER

[76] Inventor: Dave O. Foreman, 707 SE. Avenue A, Andrews, Tex. 79714

[22] Filed: July 10, 1975

[21] Appl. No.: 594,699

[52] U.S. Cl. ..... 211/51

[51] Int. Cl.[2] ..... B42F 7/10

[58] Field of Search ..... 211/44, 43, 51, 49 D, 211/89, 184; 206/74, 521; 248/350; 214/10.5 R, 10.5 D; 220/22.6, 22.4, 22.1

[56] References Cited

UNITED STATES PATENTS

| | | | |
|---|---|---|---|
| 1,271,508 | 7/1918 | Hall | 211/51 |
| 2,538,165 | 1/1951 | Randtke | 211/51 UX |
| 2,591,805 | 4/1952 | Gossett | 211/89 |
| 2,727,738 | 12/1955 | Lindley | 206/521 X |
| 2,927,699 | 3/1960 | McGraw | 211/51 |
| 2,937,745 | 5/1960 | Wilson | 206/521 |
| 3,010,540 | 11/1961 | Dahlen | 206/521 X |
| 3,035,825 | 5/1962 | Weller | 206/523 X |
| 3,130,964 | 4/1964 | Johnson | 248/350 X |
| 3,180,010 | 4/1965 | Malkasian | 29/157 R |

FOREIGN PATENTS OR APPLICATIONS

| | | | |
|---|---|---|---|
| 808,628 | 7/1951 | Germany | 211/51 |

*Primary Examiner*—Ramon S. Britts
*Assistant Examiner*—Robert W. Gibson, Jr.
*Attorney, Agent, or Firm*—Marcus L. Bates

[57] ABSTRACT

A card file holder for filing cards of various thickness and length comprising an upwardly opening U-shaped support member having a forward and a rearward wall. A foam rubber member has a forward and a rearward wall surface with one surface thereof glued to the rear wall of the support, while an opposed wall surface thereof is glued to a movable plate member. The plate member is urged toward the forward wall of the support so that cards of various thickness are captured in supported relationship between the movable plate member and the forward wall of the support.

4 Claims, 8 Drawing Figures

FILE CARD HOLDER

BACKGROUND OF THE INVENTION

Card holders which employ a spring-loaded movable plate member are available on the market. The holder generally comprises an upwardly opening box-like member having four sides attached to a bottom member, and a closure member removably or hingedly received thereon. Accordingly, the cross-sectional area of the box determines the maximum size card which can be accommodated therewithin.

In using card holders of the prior art, one must limit the number of cards placed therein to a particular size for the above mentioned reasons. The card holder is sometimes difficult to grasp in one's hand so that it cannot always be freely moved about as may be desired. When a card is removed from the card holder, it must immediately be replaced therein, or otherwise it may become lost.

Where the card holder has a movable wall member therein which is resiliently biased towards the cards, the cost of manufacture is considerable, while at the same time, the metallic springs, levers, and other coacting parts required to impart the resiliency into the apparatus become aged and eventually will chip, rust, and otherwise become bothersome.

Accordingly, it would be desirable to have a card file holder which can be used to accommodate cards of various thicknesses, lengths, and heights, which does not rust and mar the cards over a long period of time, which has a convenient handhold by which the box can be grasped and transported from one location to another, and which furthermore has some sort of means associated therewith for holding cards after they have been moved therefrom until a later time when the cards can be leisurely refiled.

| | THE PRIOR ART |
|---|---|
| Gossett | 2,591,805 |
| Unsworth | 3,171,544 |
| Randtke | 2,538,165 |
| Carr | 2,710,694 |
| Durec | 2,912,113 |
| Malkasian | 3,180,010 |

SUMMARY OF THE INVENTION

A card file holder for filing cards of varying thickness, length, and height comprising an upwardly opening U-shaped support member having a forward and rear wall. A body of deformable material having a forward and a rearward wall surface is provided with a plate member being adhered to a forward wall surface thereof, so that the rearwardly directed wall surface of the body can be adhered to the rearward wall of the support. The plate member is disposed adjacent to the forward wall of the support member so that the plate member can be resistingly urged toward one of the rearward walls and away from the forward wall of the support, thereby providing a card receiving space within which cards of varying thickness, length, and height can be stored.

In one embodiment of the invention, the body of deformable material is provided with a circular cutout which reduces the magnitude of the force which urges the plate member toward the forward wall of the support. The aperture furthermore provides a convenient handhold which enables one to grasp the box and easily transport it from one location to another.

The aperture furthermore provides a means for storing cards until they can be filed within the card holding space of the holder.

The various different embodiments of the present invention include a square, triangular, and oval aperture formed within the deformable body.

Accordingly, a primary object of the present invention is the provision of a card file holder for filing cards of varying thickness, length, and height.

Another object of the invention is the provision of a card file holder which is inexpensive to manufacture, and which is devoid of springs, linkage, levers, and other mechanical paraphernalia.

Still a further object of the invention is to provide improvements in a card file holder which provides an opened card receiving space defined by spaced movable walls which are resiliently biased towards one another by a rubber-like body of compressible material.

The above objects are attained in accordance with the present invention by the provision of an apparatus fabricated in a manner substantially as described in the above abstract and summary.

These and various other objects and advantages of the invention will become readily apparent to those skilled in the art upon reading the following detailed description and claims and by referring to the accompanying drawings.

DETAILED DESCRIPTION OF THE PREFERRED EMBODIMENTS

Figure 1:
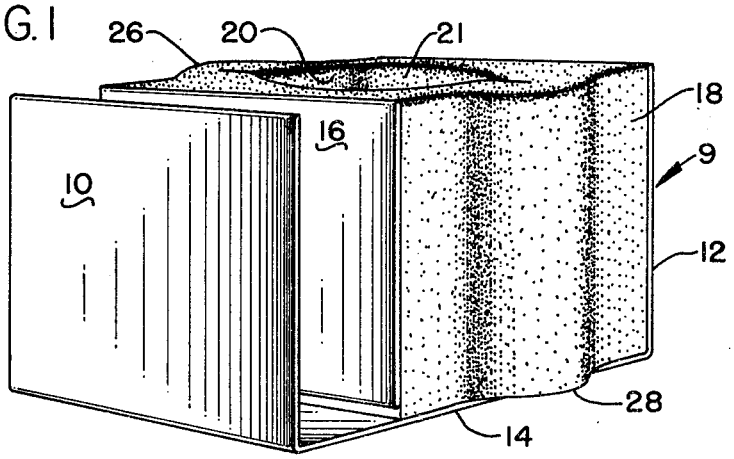
FIG. 1 is a perspective view of a file card holder made in accordance with the present invention.
Figure 2:
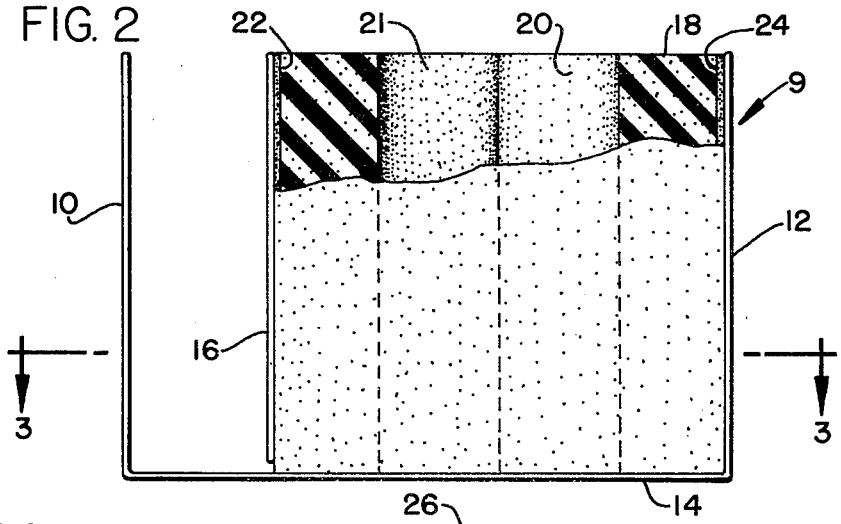
FIG. 2 is a side elevational view of the apparatus disclosed in FIG. 1.

Throughout the various figures of the drawings, wherever it is logical or practical to do so, like or similar numerals will refer to like or similar objects.

As seen in the figures of the drawing, a card file holder 9, made in accordance with the present invention, is seen to be comprised of an upwardly opening U-shaped support member having a forward wall 10, a rearward wall 12, and a bottom wall 14, joined together and preferably made from a sheet of metal, plastic, or fiberglass. The sheet of material is bent 90° at each of the illustrated corners, thereby providing a box-like structure having no side walls and no top.

A movable plate member 16 is affixed to the forward wall of a body of resilient material 18. The body preferably is a unitary mass made of foam rubber; however, other plastic or plastic-like material could be substituted therefor, so long as the body is compressible sufficiently to allow ample space to be provided for between the forward wall 10 and the movable wall 16, so that cards can be placed edgewise and stored therebetween.

Interior circumferentially extending wall 20 defines aperture 21, which preferably is vertically disposed and formed within the body. The forward wall of the body is glued or adhered at 22 to the rearwardly disposed wall surface of the movable plate. The rear wall of the body is similarly glued or adhered to the interior surface of the rearward wall, as indicated by the numeral 24.

Figure 3:
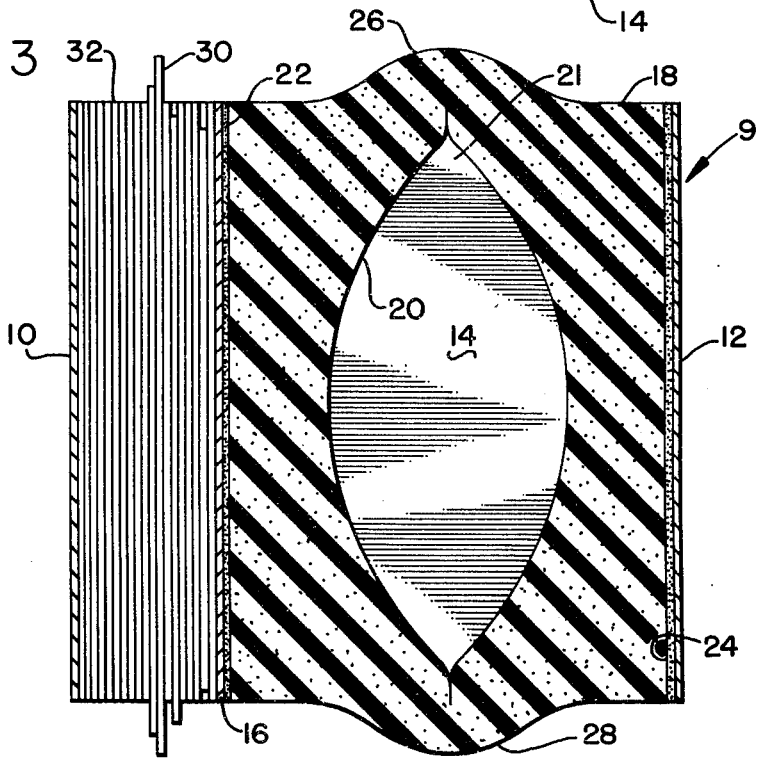
FIG. 3 is a cross-sectional view taken along line 3—3 of FIG. 4.
Figure 4:
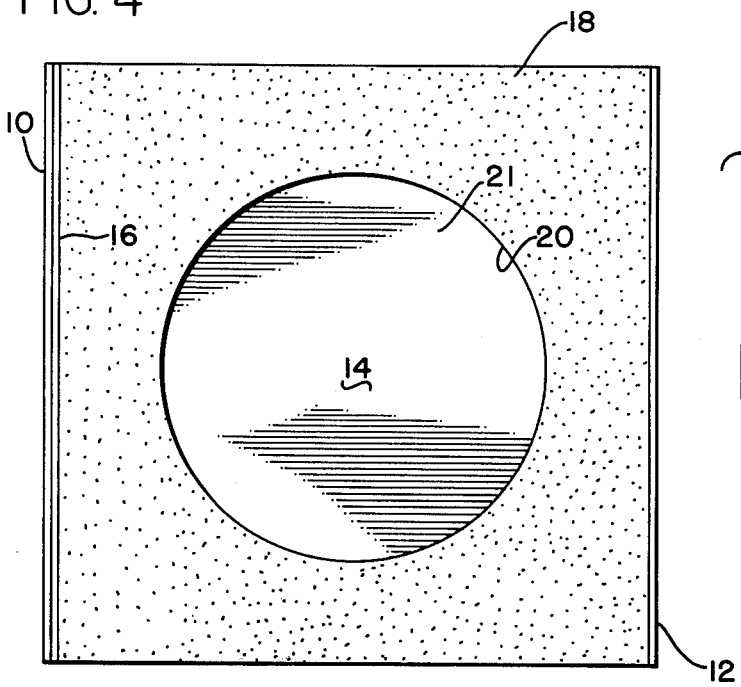
FIG. 4 is a top plan view of the apparatus disclosed in the foregoing figures.
Figure 5:
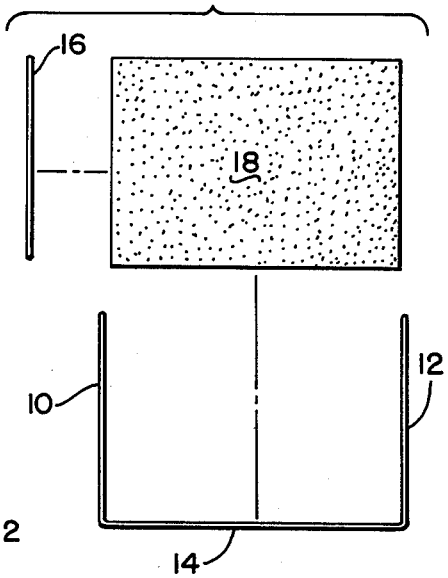
FIG. 5 is an exploded view of the apparatus disclosed in the foregoing figures; and, FIGS. 6, 7, and 8 are reduced top plan views which set forth various different embodiments of the invention.

The resilient body becomes deformed as the movable plate 16 is moved or resiliently urged toward the rearward wall 12 in the resultant manner generally indicated at 21 and 26 in FIG. 3. As the movable plate is yieldably urged toward the rear wall, the card receiving space formed between the movable plate and the forward wall accommodates a plurality of cards 30 and 32 of varying thickness, length, and height.

The aperture 21 enables one's fingers to be placed therewithin, with the thumb being disposed so that it grasps the rear wall, thereby providing a handhold by which the holder can be engaged, lifted, and transported from one location to another. Moreover, cards may be accumulated within the central aperture 21 until a convenient time arrives for filing them in the manner illustrated by the numerals 30 and 32.

The movable wall is urged toward the rear wall by grasping either the movable plate or some of the cards stored forwardly thereof and urging the plate member 16 toward the wall 12 to thereby increase the spaced distance between the plate member and the forward wall of the support.

Figure 6:
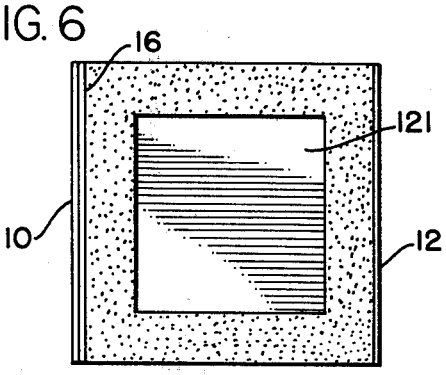
Figure 7:
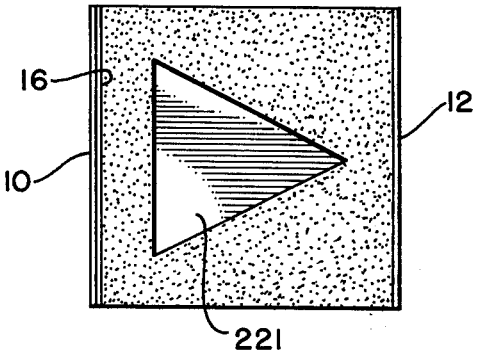

As seen in FIG. 6, the configuration of the aperture 121 can be made into a square. As seen in FIG. 7, the aperture 221 can be made triangular. It is preferred that the apex of the triangle be directed toward rear wall 12, while the base of the triangle lies spaced from and adjacent to the movable walls 16, so that deformation of the resilient body occurs symmetrically as cards are accumulated within the card receiving space of the device.

Figure 8:
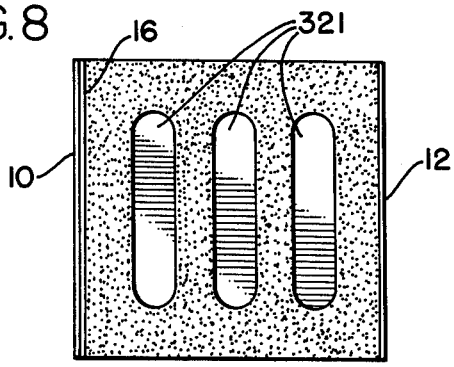

In FIG. 8, the resilient body is provided with several spaced oval apertures 321, preferably arranged so that cards may be placed into various different ones of the ovals or slots.

The purpose of aperturing the resilient body is to provide the convenience of a handhold, to provide a means for temporarily storing cards to be filed, and furthermore to increase the magnitude by which plate member 16 can be spaced from forward wall 10, while at the same time reducing the magnitude of the force required to move the movable wall 16 toward the rearward support wall 12.

The movable wall, as well as the support member, can be made of plastic, such as PVC or polystyrene. Where the support member is made of metal, it is preferred that the three exposed edge portions thereof be turned 180°, thereby presenting a smooth surface which is usually harmless when accidently contacted. The resilient body preferably is made of foam rubber similar to the foam rubber used in the manufacture of mattresses and pillows.

It should be noted that the card receiving space of the present invention has no top or side walls. The support member has no side walls; however, when the resilient body is affixed in operative relationship therewithin, the resilient body itself provides the side walls for a limited distance between the forward and rear wall of the support member.

As noted above, the resilient body is adhered to the rear wall of the support member and to one wall surface of the movable plate member; however, the resilient body is not attached to the bottom wall 14 of the support member, because it must move respective thereto.

The apparatus of the present invention is highly efficient in operation, provides a file card holder construction heretofore unknown to those skilled in the art, and the various coacting members thereof perform a plurality of novel functions which are unobvious and provide a unique desirable function.

I claim:

1. A fild card holder within which there can be stored a plurality of cards of varying thickness and any length comprising:

an upwardly opening, U-shaped support member having a forward and a rearward wall surface; a body of deformable material having a forward wall surface which can be yieldably moved toward a rearward wall surface; and a plate member;

means attaching said plate member to said forward wall surface of said body;

means attaching said rearward wall surface of said body to said rearward wall surface of said support member such that said plate member is resiliently urged toward said forward wall surface of said support member;

said body of deformable material is made of a foamed plastic which is apertured to provide an upwardly opening, card receiving opening therein; whereby:

said plate member can be yieldably urged away from said forward wall of said support member, thereby providing a card receiving space therebetween, within which cards may be stored.

2. The file card holder of claim 1 wherein said aperture is round in cross-sectional configuration, and said deformable material is made of rubber.

3. A card holding device comprising a U-shaped support member having upwardly extending forward and rear walls attached to a bottom member to form an upwardly opening space therebetween;

a resilient body member made of foamed, plastic-like material, said body member having opposed forward and rear wall surfaces; means forming an upwardly opening, card receiving opening within said resilient body member;

a movable plate member affixed to said forward wall surface of said resilient body member;

said rear wall surface of said resilient body member being affixed to the interior wall surface of said rear wall of said support member, with said movable plate member being disposed adjacent to and parallel to said forward wall of said support member; whereby:

said movable plate member can be resistingly urged toward said rear wall of said support member, thereby compressing said resilient body therebetween, while providing a card receiving space between said movable plate member and said forward wall of said support member, so that cards of any length can be stored in the card receiving space.

4. The card holding device of claim 3 wherein said resilient body is made of foam rubber, and said aperture provides an upwardly opening, card receiving space therein which is oval in cross-sectional configuration.

* * * * *